United States Patent [19]

Hedden

[11] Patent Number: 4,577,582

[45] Date of Patent: Mar. 25, 1986

[54] ANCHOR WITH PIVOTING ARMS

[76] Inventor: Roger L. Hedden, Box 33 Bl. Sky Hts., Clancy, Mont. 59634

[21] Appl. No.: 644,622

[22] Filed: Aug. 27, 1984

[51] Int. Cl.[4] ..... B63B 21/44

[52] U.S. Cl. ..... 114/298

[58] Field of Search ..... 114/297, 298, 299

[56] References Cited

U.S. PATENT DOCUMENTS 3,283,736 11/1966 Williams ..... 114/298

3,397,665 8/1968 Lindly ..... 114/298

*Primary Examiner*—Sherman D. Basinger

*Attorney, Agent, or Firm*—James D. Givnan, Jr.

[57] ABSTRACT

A tubular shank structure the anchor includes an elongate arm control member which moves lengthwise within a main body of the shank structure. Pivotally mounted arm members may be maintained collapsed along side the anchor shank structure or may be operatively held perpendicular to the shank structure by the arm control member. Upward positioning of the arm control member causes same to disengage the arm member ends to permit the arm members to rotate downwardly relative the shank structure so as to disengage an underwater obstruction. An anchor line is secured to the shank structure by a breakaway tie which, in case of anchor fouling, may be ruptured to permit positioning of the arm control member for anchor release.

3 Claims, 5 Drawing Figures

ANCHOR WITH PIVOTING ARMS

BACKGROUND OF THE INVENTION

The present invention pertains generally to anchors for a wide range of watercraft.

In the known prior art are anchors having arms pivotally joined to the anchor shank for purposes of disengagement of a fouled anchor from an underwater obstruction to avoid anchor loss. Examples of prior art anchors having pivotable arms are found in U.S. Pat. Nos. 363,579; 411,948; 2,540,867 and 3,397,665. Additional prior art discloses boat anchors wherein anchor arms are adapted to swing relative to an anchor shank such as those anchors described in U.S. Pat. Nos. 2,056,439 and 2,789,526 which have shearable components to permit repositioning of an anchor arm for purposes of withdrawl from an underwater obstruction. Still further prior art discloses the concept of anchor components held in place by ties as in U.S. Pat. Nos. 3,397,665 and 805,535 which may be broken by increased anchor line tension to reconfigure the anchor for disengagement from an obstruction.

SUMMARY OF THE PRESENT INVENTION

The present invention is embodied within an anchor having arms each positionable through a wide arc of travel for both anchor stowage as well as anchor release from an underwater obstruction.

The present anchor is embodied in a shank structure having a lengthwise movable arm control member engaged by anchor arms to maintain same in their operative position. Arm mounting means comprises paired flanges between each pair of which is swingably mounted an anchor arm for travel substantially through a semicircular arc. When configured for anchor stowage aboard a boat, the anchor arms are collapsed into parallel relationship with the anchor shank. Accordingly, the anchor may be stowed within a small area away from risk of injurious contact with a boat occupant. The arm control member engages the arm ends to restrict the arms against downward movement.

Important objectives of the present invention include the provision of an anchor having arms positionable into multiple configurations including operative, stowed and anchor releasing positions; the provision of an anchor wherein the anchor arms may be held in substantially parallel relationship with anchor shank structure to enable compact stowage of the anchor aboard a boat; the provision of an anchor having a shank structure including a slidable arm control member whose travel is limited by a limit stop pin which rides in a keyway in the arm control members; the provision of an anchor wherein an exposed, easily replaced breakaway strap normally secures an anchor line to a shank mounted bail member and which strap, when subjected to tension, breaks to permit repositioning of the arm control member and in turn release of the anchor arms for anchor disengagement from an underwater obstruction.

BRIEF DESCRIPTION OF THE DRAWING

In the accompanying drawing.

DETAILED DESCRIPTION OF THE PREFERRED EMBODIMENT

Figure 1:
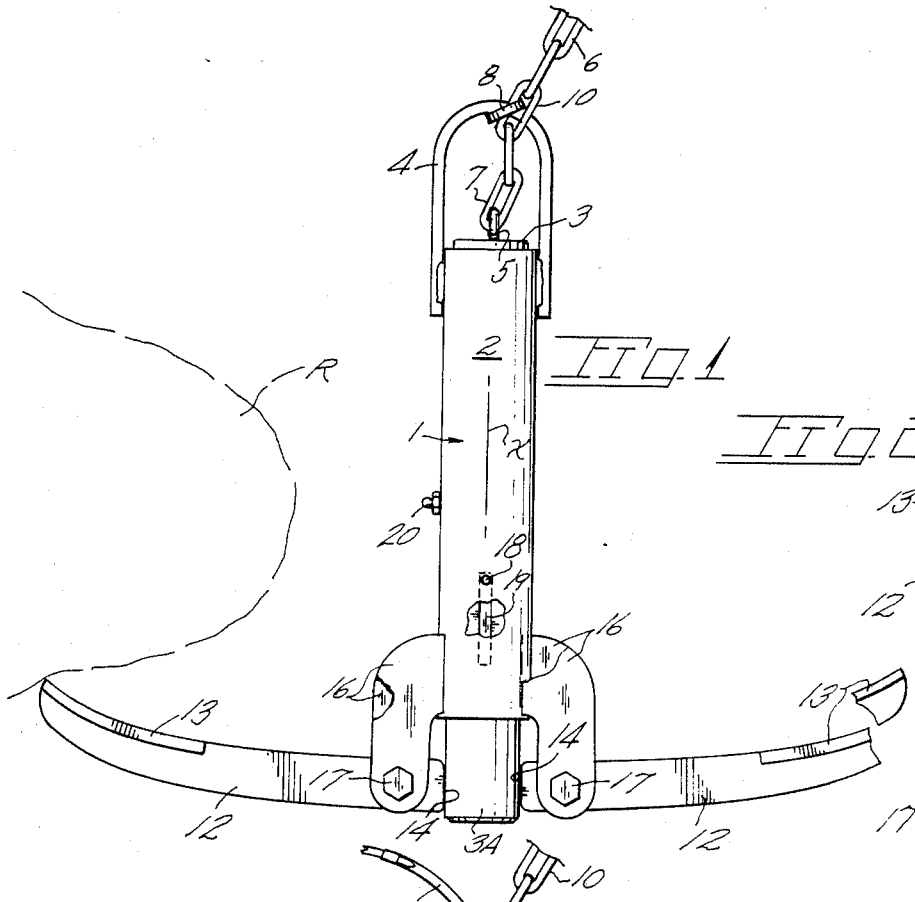
FIG. 1 is a front elevational view of the present anchor operatively disposed.

With continuing attention to the drawing wherein reference numerals indicate parts similarly hereinafter identified, the reference numeral 1 indicates generally the shank structure of the present anchor.

Shank structure 1 includes a tubular main body 2 open at its ends to slidably receive an arm control member 3. An anchor bail at 4 is suitably secured as by welds to the upper end of main body 2 and serves to receive an exposed breakaway strap as later described. Arm control member 3 is equipped at its upper end with an eye 5 within which is secured an end link 7 of an anchor line 6.

A breakaway tie or strap 8 normally secures an anchor link 10 to bail 4 in a manner permitting anchor use in the usual manner and additionally line-bail separation upon extraordinary forces being exerted on the anchor line as for example when the anchor is fouled on an underwater obstruction R.

During usual anchor use arm members at 12 are normally disposed substantially perpendicular to the upright axis x of main body 2. The proximal ends 14 of the arms normally abut the lower most end portion 3A of arm control member 3 as shown in FIG. 1. The outer arm ends are equipped with flukes 13.

Figure 2:
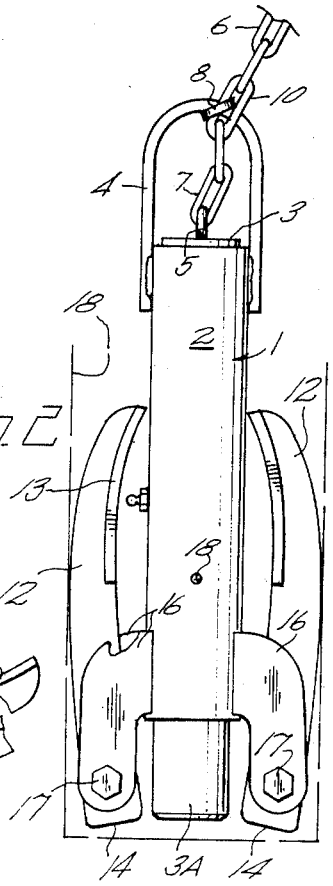
FIG. 2 is front elevational view of the anchor configured for stowage purposes.

Arm mounting means comprises pairs of parallel flanges 16 which depend below the lowermost end of tubular main body 2 and thereat receive bolt assemblies 17 which constitute pivots for arm members 12. The flanges 16 are spaced from one another a distance to receive an arm member 12 and to confine same for travel in a plane containing axis x of main body 2. With reference to FIG. 2 it will be seen that each arm member 12 may be swung in the aforementioned plane to a position substantially parallel with tubular main body 2 to permit the anchor to be stowed within a small storage area 18 only somewhat greater in width than the main body 2 of the anchor. The arm members 12 are maintained in stowed configuration by reason of arm ends 14 being proximate the lower end portion 3A of arm control member 3 which has been returned to its lower limit of travel subsequent to arm member positioning.

Figure 3:
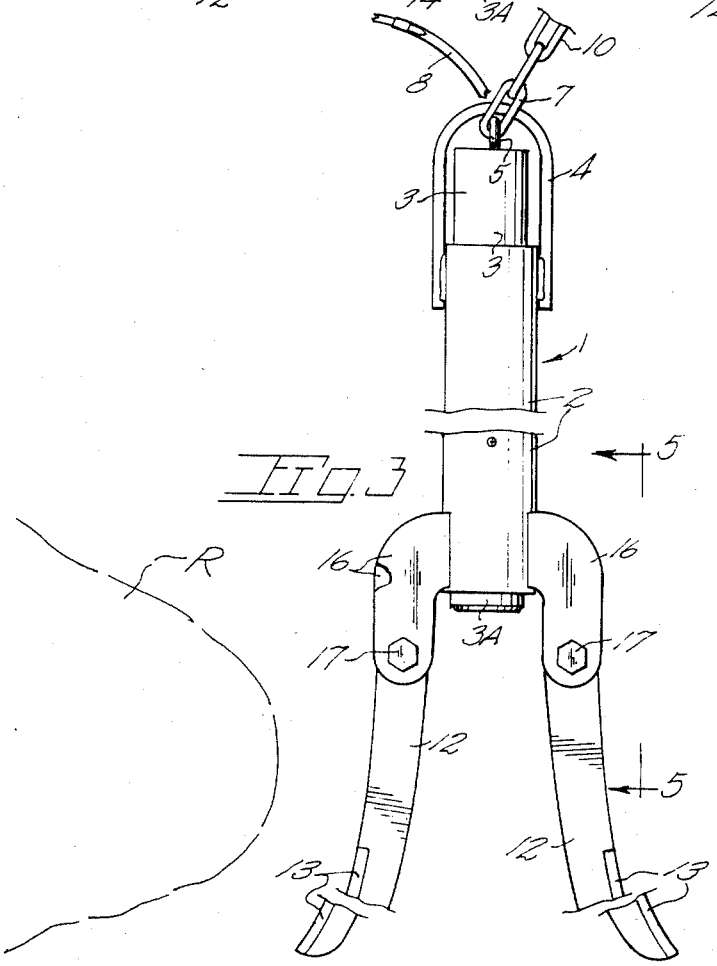
FIG. 3 is a front elevational view of the anchor sectioned for purposes of illustration and with the anchor arms in an anchor releasing position.
Figure 4:
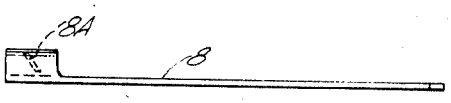
FIG. 4 is a side elevational view of a breakaway tie used with the present anchor.
Figure 5:
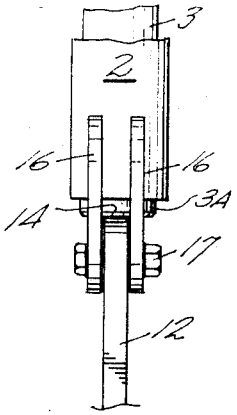
FIG. 5 is a vertical elevational view taken along line 5—5 of FIG. 3.

In FIG. 3 the anchor is shown in still another or a third configuration wherein arm members 12 are repositioned downward relative main body 2 to a trailed position either from contact with an underwater obstruction drag, gravity or a combination thereof. Release of the arm members by the boat operator is accomplished by upward extraction of arm control member 3 by anchor line 6 to permit arm ends 14 to rotate. Upward movement of arm control member 3 results from increased tensioning of anchor line 6 coincident the anchor being restrained by an obstruction with the increased tension causing tie or strap 8 to rupture with the anchor line thereafter repositioning arm control member 3. Strap 8 may be embodied within a nylon tie of the type commonly used for bundling electrical conduits and formed with a metal clip 8A wich engages serrations on the inserted segment of the tie. Such ties are in common use in the electrical field and are of nylon capable of withstanding normal anchor line imparted forces but subject to breaking when subjected to rapid, momentary tensioning as when the boat operator exerts sudden, forceful pulls on the line. Forces encountered during moorage of the boat from winds and currents are, of course, not adequate to rupture the tie 8. A replacement tie or strap 8 may be readily applied to an anchor line link and bail 4 without undue effort.

Travel of arm control member 3 is limited by an internal limit stop pin 18 in the wall of tubular main body 2. A keyway 19 in arm control member 3 receives the inner end of pin 18. A lubrication fitting is at 20.

While I have shown but one embodiment of the invention it will be apparent to those skilled in the art that the invention may be embodied still otherwise without departing from the spirit and scope of the invention.

Having thus described the invention, what is claimed and desired to be secured in Letters Patent is:

1. An anchor having positionable arm members enabling anchor stowage in a compact manner and also anchor release when fouled on an underwater obstruction, said anchor comprising, a tubular shank structure including an upright tubular main body and an elongate arm control member slidably disposed in the tubular main body, a bail secured to the upper end of said main body and projecting thereabove, a limit stop limiting travel between said main body and said arm control member, arm members having their proximal ends located adjacent one end of said tubular main body, pairs of flanges secured to and depending below said one end of the tubular main body with one each of said arm members swingably mounted between one of said pairs of flanges for travel through approximately 180 degrees whereby the arms may be placed in juxtaposition with the tubular main body of the shank structure for anchor stowage purposes and additionally in a trailed position offset below the tubular main body for anchor retrieval purposes, said arm control member engageable with the proximal ends of the arm members to retain same in an operative position substantially perpendicular to the tubular shank structure, an anchor line, means securing the lowermost end of the anchor line to the upper end of said arm control member, and a breakaway tie passing through said bail on the main body and normally securing the anchor line to said tubular main body for imparting raising or lowering forces to the anchor whereby upon rupture of the breakaway tie by anchor line exerted forces said anchor line will impart axial movement to said arm control member for disengagement of same with the arm member ends to permit a fouled arm member to swing out of contact with an underwater obstruction.

2. The anchor claimed in claim 1 wherein said arm members are confined against downward travel to an operative position by said arm control member.

3. The anchor claimed in claim 1 wherein said breakaway tie is of nylon construction having a metal clip.

* * * * *